US008888534B2

(12) United States Patent
Toda

(10) Patent No.: US 8,888,534 B2
(45) Date of Patent: Nov. 18, 2014

(54) CONNECTING COMPONENT

(75) Inventor: Kentaro Toda, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 259 days.

(21) Appl. No.: 13/600,019

(22) Filed: Aug. 30, 2012

(65) Prior Publication Data

US 2013/0164988 A1 Jun. 27, 2013

(30) Foreign Application Priority Data

Dec. 22, 2011 (JP) ..... 2011-280830

(51) Int. Cl.
*H01R 24/00* (2011.01)

(52) U.S. Cl.
USPC ..... 439/630

(58) Field of Classification Search
USPC ..... 439/630–632
See application file for complete search history.

(56) References Cited

U.S. PATENT DOCUMENTS

| | | | | |
|---|---|---|---|---|
| 7,094,093 | B2 * | 8/2006 | Nakano et al. | 439/495 |
| 7,390,204 | B2 * | 6/2008 | Tanaka et al. | 439/159 |
| 7,438,599 | B2 * | 10/2008 | Uchida et al. | 439/630 |
| 7,448,890 | B2 * | 11/2008 | Ting | 439/159 |
| 7,993,151 | B2 * | 8/2011 | Chuo et al. | 439/260 |

FOREIGN PATENT DOCUMENTS

JP 2000-306621 11/2000

* cited by examiner

*Primary Examiner* — Truc Nguyen
(74) *Attorney, Agent, or Firm* — Hovey Williams LLP

(57) ABSTRACT

A connecting component includes a housing, housing connection terminals secured to the housing, an abutment located beneath the housing connection terminals, a first guide portion located beneath the housing connection terminals for regulating a position of a bottom surface of the subsidiary board, second guide portions located in front of the first guide portion as seen in a subsidiary board insertion direction for regulating the top surface of the subsidiary board, and third guide portions located in front of the first guide portion as seen in the subsidiary board insertion direction on a straight line passing through the first guide portion and the second guide portions and disposed in a position away from the abutment by a distance longer than an overall length of the subsidiary board, the third guide portions regulating the position of the bottom surface of the subsidiary board.

10 Claims, 6 Drawing Sheets

CONNECTING COMPONENT

BACKGROUND OF THE INVENTION

The present invention relates to a connecting component and in particular to a connecting component for mounting a subsidiary board having connection terminals on its top surface onto, for example, a connector part or a main board.

Mounting a subsidiary board such as an IC card incorporating electronic circuits therein to a main board to expand the functions has been heretofore practiced in the art.

JP 2000-306621 A, for example, describes a connector for connecting a subsidiary board to a main board. As illustrated in FIG. 16, the connector comprises a housing 2 mounted on the top surface of a main board 1. There is provided in the housing 2 a groove 4 into which the end of a card 3 serving as a subsidiary board is inserted. The groove 4 is provided therein with connector connection terminals 6 that are connected with card connection terminals 5 provided on both sides of the card 3.

For attachment of the card 3 to the connector, the card 3 is inserted at an angle into an opening of the groove 4, then moved in a direction D1 along the groove 4, and after the forward end of the card 3 contacts with the end of the groove 4, the card 3 is depressed in a direction D2 toward the top surface of the main board 1. The card 3 is now substantially parallel to the top surface of the main board 1 as shown by the chain line, while the connector connection terminals 6 undergo elastic deformation as they are pushed by the respective card connection terminals 5, establishing electric connection therebetween.

The connector connection terminals 6 have a gently curving, up-turned shape to enable smooth insertion of the card 3.

Therefore, when the card 3 is positioned substantially parallel to the top surface of the main board 1 and the connector connection terminals 6 are in elastic contact with the card connection terminals 5, the tips of the connector connection terminals 6 are turned up away from the card connection terminals 5. Thus, the up-turned portions of the tips of the connector connection terminals 6 form stubs that deteriorate high frequency characteristics, making it difficult to perform signal transmission at such high speed as about 10 Gbps and over with high accuracy.

If the tips of the connector connection terminals 6 be each formed into a straight line instead of an up-turned shape in order not to allow stubs to be formed, the connector connection terminals 6 might hit the forward end of the card 3 upon insertion of the card 3, possibly damaging the connector connection terminals 6, or the edges of the connector connection terminals 6 might abrade the surfaces of the card 3 to damage the card 3.

SUMMARY OF THE INVENTION

An object of the present invention is to overcome the above problems in the art and provide a connecting component allowing excellent high frequency characteristics to be achieved while enabling smooth attachment of a subsidiary board.

A connecting component according to the present invention comprises a housing for accommodating a subsidiary board inserted in a direction along a top surface of the subsidiary board; housing connection terminals secured to the housing and provided for connection to the subsidiary board connection terminals; an abutment located beneath the housing connection terminals and with which a forward end of the subsidiary board inserted into the housing contacts; a first guide portion located beneath the housing connection terminals for regulating a position of a bottom surface of the subsidiary board when the subsidiary board is inserted into the housing; second guide portions located in front of the first guide portion as seen in a subsidiary board insertion direction for regulating a position of the top surface of the subsidiary board when the subsidiary board is inserted into the housing; and third guide portions located in front of the second guide portions as seen in the subsidiary board insertion direction on a straight line passing through the first guide portion and the second guide portions and disposed in a position away from the abutment by a distance longer than an overall length of the subsidiary board, the third guide portions regulating a position of the bottom surface of the subsidiary board when the subsidiary board is inserted into the housing, wherein the first guide portion, the second guide portions, and the third guide portions form an insertion path for inserting the subsidiary board into the housing without allowing the subsidiary board to contact with the housing connection terminals, and wherein by depressing a rear end of the subsidiary board toward a base portion of the housing after the subsidiary board is inserted into the housing along the insertion path until the forward end of the subsidiary board contacts with the abutment, the subsidiary board pivots to bring the subsidiary board connection terminals to contact with bottom surfaces of the housing connection terminals.

DETAILED DESCRIPTION OF THE INVENTION

Embodiments of the present invention will be described below based on the appended drawings.

Embodiment 1

Figure 1:
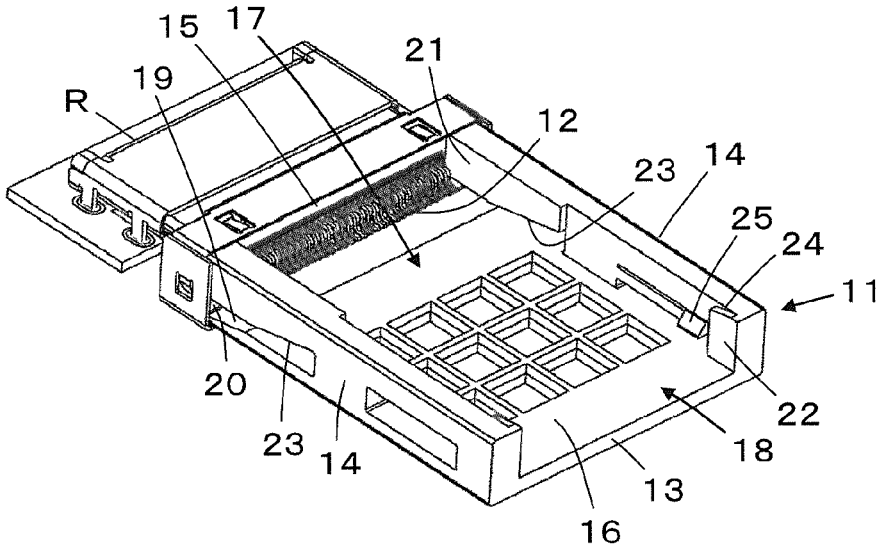
FIG. 1 is a perspective view of a connecting component according to Embodiment 1 of the invention.
Figure 2:
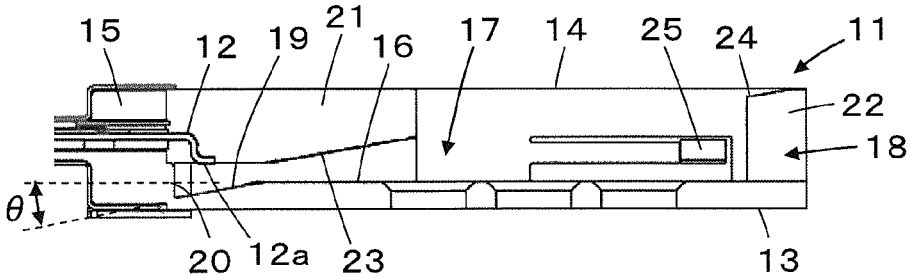
FIG. 2 is a cross sectional view of the connecting component according to Embodiment 1.

FIGS. 1 and 2 illustrate a configuration of a connecting component according to Embodiment 1 of the invention. The connecting component constitutes a part of a plug connector part of a pair of connector parts connected to each other and comprises a housing 11 shaped generally like a tray and a plurality of housing connection terminals 12 secured to the housing 11.

The housing 11 comprises a rectangular base portion 13 having a pair of longer sides and a pair of shorter sides, a pair of upright side walls 14 provided opposite each other along the longer sides of the base portion 13, and an end wall 15 erected along one of the pair of the shorter sides of the base portion 13 and connected with both the side walls 14. A top surface 16 of the base portion 13 is surrounded on three sides by the pair of side walls 14 and the end wall 15, forming a recessed containing portion 17 for a subsidiary board. On the other shorter side of the base portion 13 opposite the end wall 15, no wall portion is provided, and an opening 18 is formed instead.

The top surface 16 of the base portion 13 of the housing 11 forms a subsidiary board support portion in the invention.

The housing connection terminals 12 extend parallel to the top surface 16 of the base portion 13 through the end wall 15 and are thus supported by the end wall 15. One ends of the housing connection terminals 12 protrude into the subsidiary board containing portion 17 with having a gull-wing shape (a terminal shape bent step-wise with a soldered portion lying parallel to the board) and contact portions 12*a* are formed on the lower surfaces of the tips thereof. The contact portions 12*a* of the housing connection terminals 12 are arrayed on a straight line parallel to the top surface 16 of the base portion 13 and extending perpendicular to the side walls 14 in the subsidiary board containing portion 17.

A first slope 19 slanted downward at a given angle θ toward the end wall 15 is formed on the portion of the top surface 16 of the base portion 13 located immediately beneath the contact portions 12*a* of the housing connection terminals 12. The first slope 19 extends across the whole width of the subsidiary board containing portion 17 between the side walls 14. The wall surface of the end wall 15 connected to the lower end of the first slope 19 and facing the subsidiary board containing portion 17 forms an abutment 20.

The pair of side walls 14 each have a boss 21 raised inwardly of the subsidiary board containing portion 17 near the end wall 15 and a boss 22 raised inwardly of the subsidiary board containing portion 17 at the opening 18. The distance between the bosses 21 and the distance between the bosses 22 of the side walls 14 are smaller than the width of a subsidiary board to be contained in the subsidiary board containing portion 17 while the distance between the side walls 14 where the bosses 21 and 22 are not provided is slightly greater than the width of the subsidiary board.

A second slope 23 slanted downward at the same angle θ as the first slope 19 toward the end wall 15 is formed on each of the lower surfaces of the bosses 21 positioned near the end wall 15. Each of the second slopes 23 is parallel to the first slope 19 and positioned above the extension of the first slope 19 by a distance slightly greater than the thickness of the subsidiary board to be contained in the subsidiary board containing portion 17.

A third slope 24 slanted downward at the same angle θ as the first slope 19 and the second slopes 23 toward the end wall 15 is formed on each of the upper surfaces of the bosses 22 positioned near the opening 18. Each of the third slopes 24 is positioned on the extension of the first slope 19. The distance from the end of the first slope 19 closer to the opening 18 to the ends of the third slopes 24 closer to the end wall 15 is shorter than the overall length of the subsidiary board to be contained into the subsidiary board containing portion 17, while the distance from the abutment 20 to the ends of the third slopes 24 closer to the end wall 15 is longer than the overall length of the subsidiary board to be contained into the subsidiary board containing portion 17.

The first slope 19, the second slopes 23, and the third slopes 24 respectively constitute a first guide portion, second guide portions, and third guide portions in the present invention and are molded in one piece with the housing 11 when the housing 11 is manufactured. The first slope 19, the second slopes 23, and the third slopes 24 form an insertion path for inserting the subsidiary board into the housing 11 without allowing the subsidiary board to contact with the housing connection terminals 12.

There is a lock member 25 made of a cantilever (i.e. an elastic piece) formed on each of the side walls 14 between the boss 21 and the boss 22 having its lower end portion protruding into the subsidiary board containing portion 17. Each of the lock members 25 is positioned above the top surface 16 of the base portion 13 of the housing 11 by a distance slightly greater than the thickness of the subsidiary board and has a configuration such that the amount of protrusion into the subsidiary board containing portion 17 gradually increases toward the lower portion thereof.

The other ends of the housing connection terminals 12 extend out of the housing 11 to provide a plug contact for a plug connector part. FIG. 1 illustrates a receptacle connector part R coupled with the plug connector part.

Figure 3:
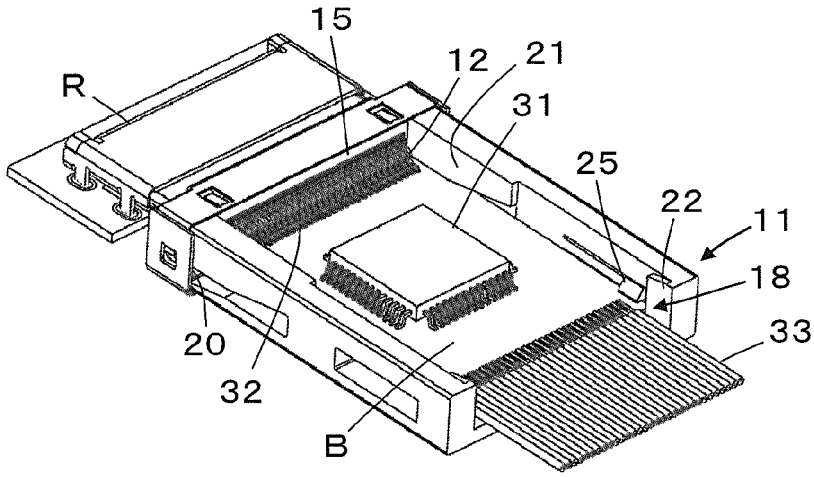
FIG. 3 is a perspective view of the connecting component according to Embodiment 1 where a subsidiary board is mounted.
Figure 4:
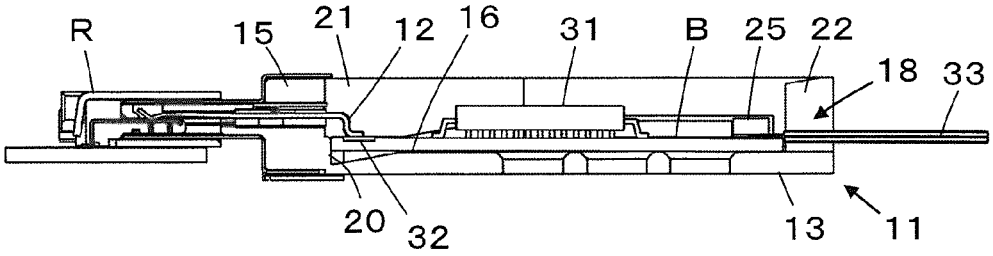
FIG. 4 is a cross sectional view of the connecting component according to Embodiment 1 where the subsidiary board is mounted.

FIGS. 3 and 4 illustrate the connecting component with a subsidiary board B mounted thereon. The subsidiary board B has a semiconductor chip 31 mounted at the center thereof and subsidiary board connection terminals 32 arrayed on the surface of the subsidiary board B near the forward end thereof. The rear end of the subsidiary board B is connected with a cable 33.

The subsidiary board B is placed along the top surface 16 of the base portion 13 with the forward end thereof being in contact with the abutment 20 of the housing 11, and the subsidiary board connection terminals 32 are in contact with the contact points 12*a* of the respective housing connection terminals 12. The subsidiary board B is now engaged with the lock members 25 so that the subsidiary board B is locked in position. The cable 33 connected to the rear end of the subsidiary board B extends outwardly from the connecting component through the opening 18 of the housing 11.

In this state, the housing connection terminals 12 are connected with the respective subsidiary board connection terminals 32 by means of soldering. Since the subsidiary board B is locked in position by the lock members 25, soldering can be performed without the possibility of the subsidiary board connection terminals 32 moving out of alignment with the housing connection terminals 12, increasing the efficiency with which soldering is performed.

After soldering, with the subsidiary board B locked in position by the lock members 25, even if a stress is applied to the subsidiary board B through, for example, the cable 33 from the outside, the stress is not transmitted to the soldered portions, and therefore a reliable connection can be established between the housing connection terminals 12 and the subsidiary board connection terminals 32.

Next, a method of mounting the subsidiary board B to the connecting component will be described.

Figure 5A:
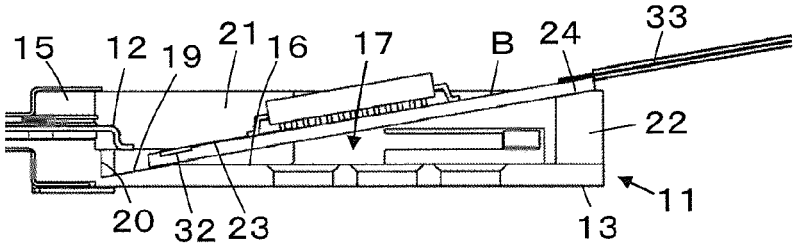
FIGS. 5A to 5D are cross sectional views illustrating the steps of attaching the subsidiary board to the connecting component according to Embodiment 1.

First, the subsidiary board B is inserted into the subsidiary substrate containing portion 17 of the housing 11 with the subsidiary board B being tilted so as to lower the forward end thereof until the forward end of the subsidiary board B contacts with the top surface 16 of the base portion 13 of the housing 11 while the bottom surface of the rear end of the subsidiary board B contacts with the third slopes 24 formed on the upper surfaces of the bosses 22 of the housing 11. When the subsidiary board B is slid toward the end wall 15 of the housing 11 with the forward end of the subsidiary board B kept in contact with the top surface 16 of the base portion 13 and with the bottom surface of the rear end of the subsidiary board B kept in contact with the third slopes 24, the bottom surface of the forward end of the subsidiary board B starts to ride on the first slope 19 of the housing 11 as illustrated in FIG. 5A. The top surface of the subsidiary board B at the forward end thereof on both sides is now positioned immediately beneath the second slopes 23 formed on the lower surfaces of the bosses 21 of the housing 11.

Thus, in a direction perpendicular to the subsidiary board B, the position of the bottom surface of the forward end of the subsidiary board B is regulated by the first slope 19, the position of the top surface of the forward end of the subsidiary board B is regulated by the second slopes 23, and the position of the bottom surface of the rear end of the subsidiary board B is regulated by the third slopes 24. Accordingly, the subsidiary board B is now positioned on the only insertion path defined by the first slope 19, the second slopes 23 and the third slopes 24 for guiding the insertion of the subsidiary board B into the subsidiary substrate containing portion 17 of the housing 11.

Figure 6:
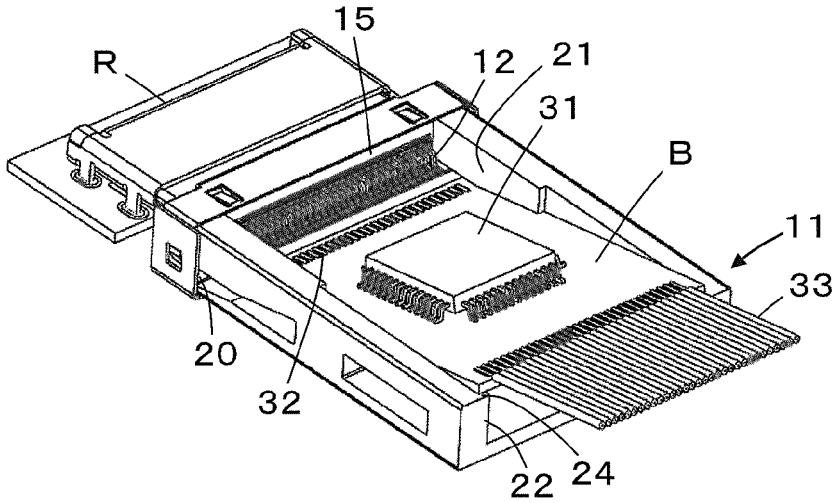
FIG. 6 is a perspective view of the connecting component according to Embodiment 1 where mounting of the subsidiary board has been started.
Figure 7:
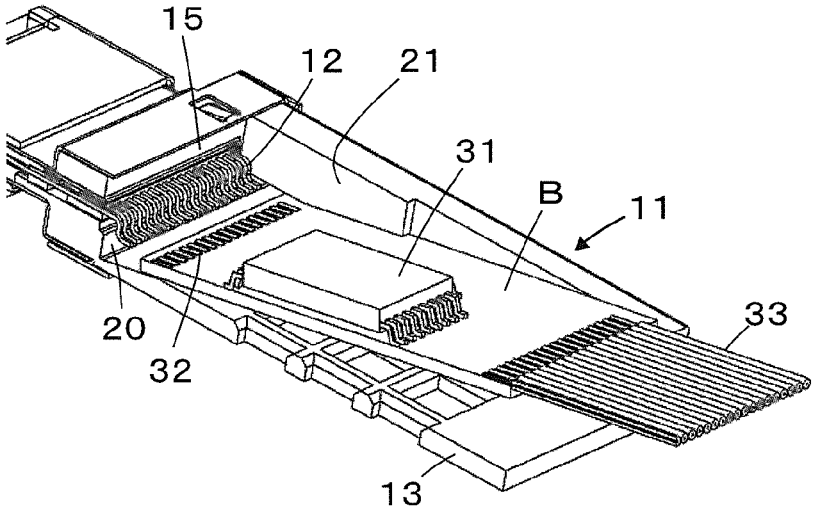
FIG. 7 is a cut-out perspective view of the connecting component according to Embodiment 1 where mounting of the subsidiary board has been started.

As illustrated in FIGS. 6 and 7, the subsidiary board connection terminals 32 of the subsidiary board B have not yet reached the housing connection terminals 12 of the housing 11.

Figure 5B:
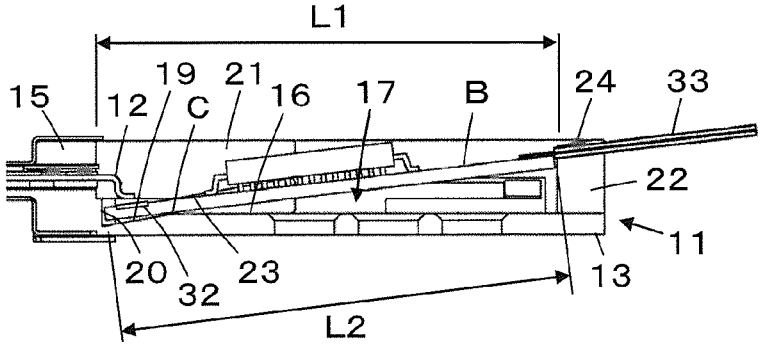

When the subsidiary board B is further inserted along the insertion path toward the end wall 15 of the housing 11, the forward end of the subsidiary board B contacts with the abutment 20 of the housing 11 as illustrated in FIG. 5B. Since the first slope 19 forming part of the insertion path is inclined downward toward the end wall 15 at a given angle θ from the top surface 16 of the base portion 13, the forward end of the subsidiary board B slanted along the insertion path is at a lower position than the housing connection terminals 12, thus preventing the subsidiary board B from contacting with the housing connection terminals 12 upon insertion thereof. Therefore, the subsidiary board connection terminals 32 formed on the top surface of the subsidiary board B near the forward end thereof are not yet in contact with the housing connection terminals 12.

Further, because a distance L1 from the abutment 20 to the ends of the third slopes 24 closer to the end wall 15 is longer than an overall length L2 of the subsidiary board B, when the subsidiary board B is inserted until the forward end of the subsidiary board B contacts with the abutment 20, the rear end of the subsidiary board B disengages from the third slopes 24 of the housing 11 to be positioned away from the boss 22 and closer to the end wall 15.

Figure 5C:
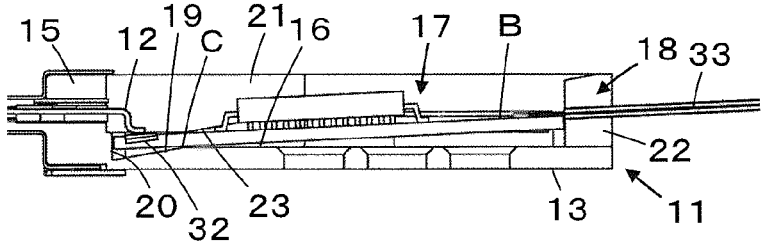

Therefore, the bottom surface of the rear end of the subsidiary board B is now free from the positional limitation by the third slopes 24, and thus the subsidiary board B is ready to be pivoted on a boundary C between the first slope 19 and the top surface 16 of the base portion 13 in a direction such that the forward end of the subsidiary board B ascends and the rear end thereof descends. Thus, when the rear end of the subsidiary board B is depressed toward the base portion 13 of the housing 11 so that the subsidiary board B pivots as illustrated in FIG. 5C, the subsidiary board connection terminals 32 of the subsidiary board B approaches the housing connection terminals 12 from beneath while the cable 33 connected to the rear end of the subsidiary board B is inserted into the opening 18 of the housing 11.

Figure 5D:
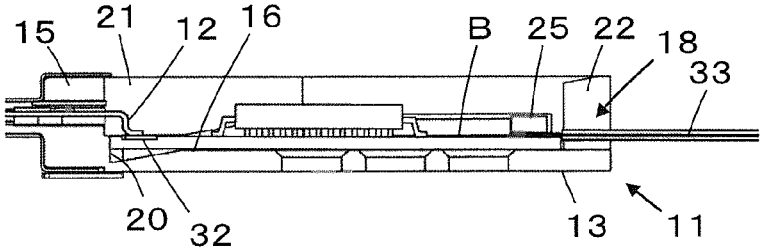
Figure 8:
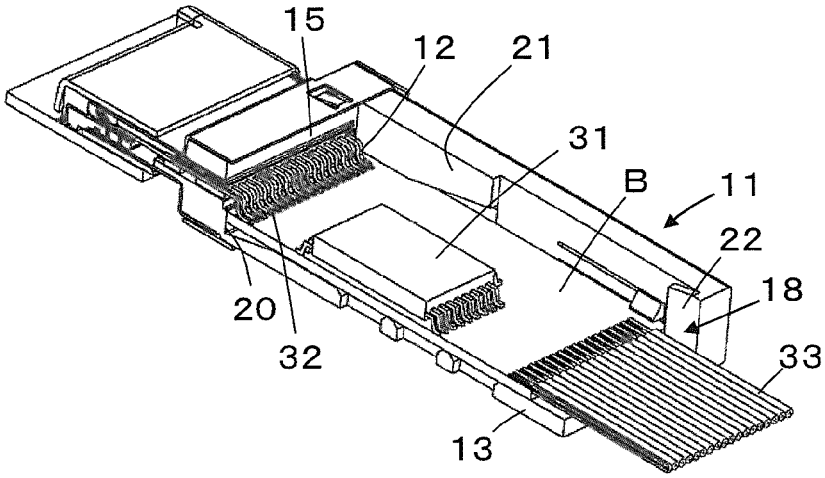
FIG. 8 is a cut-out perspective view of the connecting component according to Embodiment 1 where mounting of the subsidiary board has been completed.

Then, when the subsidiary board B is pivoted until the bottom surface of the subsidiary board B contacts with the top surface 16 of the base portion 13 of the housing 11 as illustrated in FIG. 5D, the subsidiary board B engages with the lock members 25 to be locked in position and is supported by the top surface 16 of the base portion 13 of the housing 11. At this time, the subsidiary board connection terminals 32 contact with the contact points 12*a* of the respective housing connection terminals 12 as illustrated in FIG. 8.

As described above, according to Embodiment 1, the first slope 19, the second slopes 23, and third slopes 24 constitute the single insertion path for guiding the subsidiary board B into the subsidiary substrate containing portion 17 of the housing 11 and, by inserting the subsidiary board B along the insertion path and depressing the rear end of the inserted subsidiary board B toward the base portion 13 of the housing 11 to pivot the subsidiary board B, the subsidiary board connection terminals 32 can contact with the contact points 12*a* of the housing connection terminals 12 from beneath. Therefore, even if the housing connection terminals 12 having a gull-wing shape which is a shape such that the tips are not turned up are used, it enables smooth attachment of the subsidiary board B to the connecting component and enables the subsidiary board connection terminals 32 to contact with the housing connection terminals 12 without forming any stubs.

Embodiment 2

Figure 9:
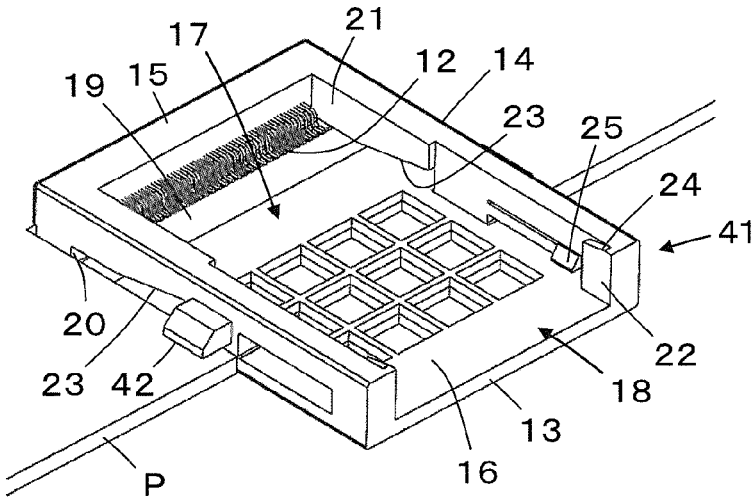
FIG. 9 is a perspective view of a connecting component according to Embodiment 2.

While the connecting component according to Embodiment 1 is adapted to attach a subsidiary board to a plug connector part, a connecting component is used to attach a subsidiary board to a main board in Embodiment 2. FIG. 9 illustrates a connecting component according to Embodiment 2.

The connecting component comprises a housing 41 secured to a main board P and housing connection terminals 12 connected to the housing 41.

The housing 41 comprises support members 42 placed in contact with the top surface of the main board P to support the housing 41 but otherwise has the same configuration as the housing 11 of the connecting component according to Embodiment 1. Thus, the top surface 16 of the base portion 13 is surrounded on three sides by the pair of side walls 14 and the end wall 15, forming the subsidiary board containing portion 17 having a recessed shape. The remaining one side of the top surface 16 of the base portion 13 has the opening 18. The first slope 19 is formed on the top surface 16 of the base portion 13 on the side closer to the end wall 15. The second slopes 23 and the third slopes 24 are formed respectively on the lower surfaces of the bosses 21 of the pair of the side walls 14 near the end wall 15 and on the upper surfaces of the bosses 22 of the pair of the side walls 14 at the opening 18. The wall surface of the end wall 15 forms the abutment 20. The lock member 25 is formed on each of the side walls 14 between the boss 21 and the boss 22.

Figure 10:
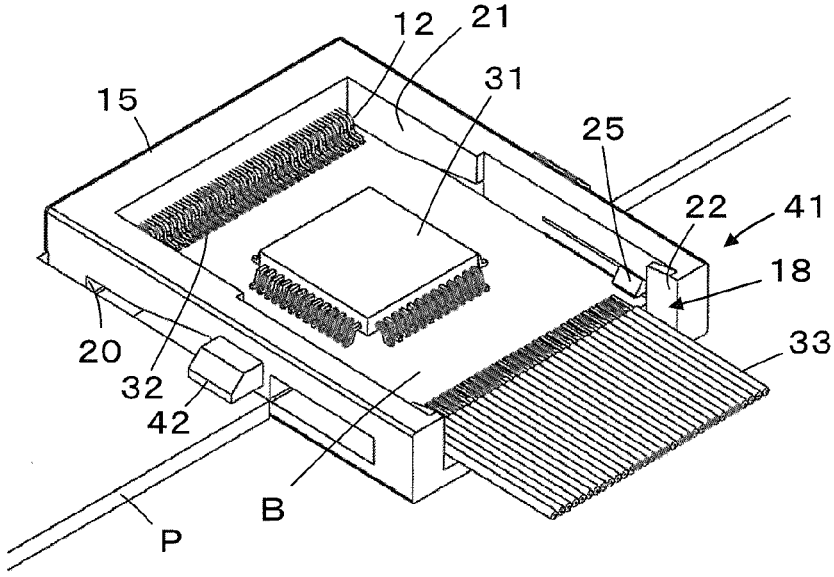
FIG. 10 is a perspective view of the connecting component according to Embodiment 2 with a subsidiary board mounted.
Figure 11:
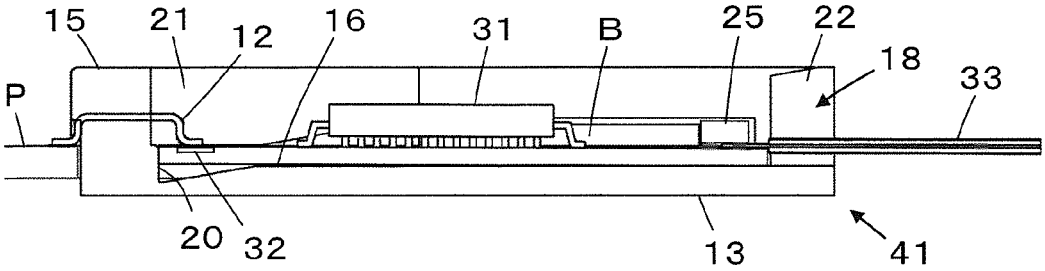
FIG. 11 is a cross sectional view of the connecting component according to Embodiment 2 with the subsidiary board mounted.

FIGS. 10 and 11 illustrate the connecting component according to Embodiment 2 with the subsidiary board B mounted thereon. The subsidiary board B is placed along the top surface 16 of the base portion 13 with the forward end thereof being in contact with the abutment 20 of the housing 41, and the subsidiary board connection terminals 32 are in contact with the lower surfaces of the respective housing connection terminals 12. The subsidiary board B is locked in position by the lock members 25. The cable 33 connected to the rear end of the subsidiary board B extends outwardly from the connecting component through the opening 18 of the housing 41. In this state, the housing connection terminals 12 are connected with the respective subsidiary board connection terminals 32 by means of soldering.

Figure 12:
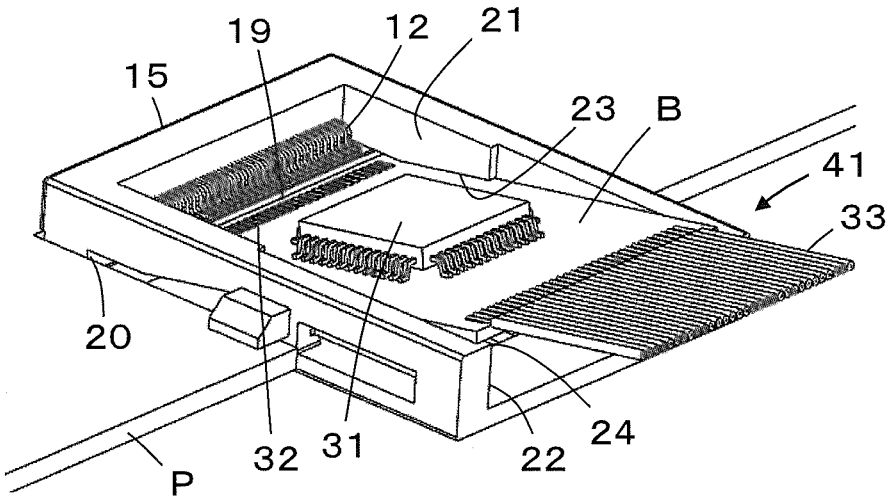
FIG. 12 is a perspective view of the connecting component according to Embodiment 2 where mounting of the subsidiary board has been started.
Figure 13:
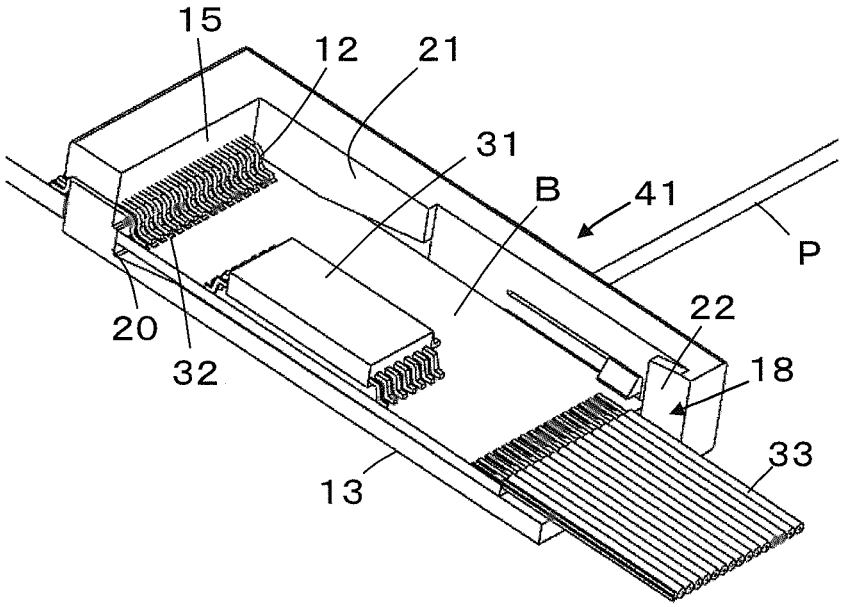
FIG. 13 is a cut-out perspective view of the connecting component according to Embodiment 2 where mounting of the subsidiary board has been completed.

As in Embodiment 1, the subsidiary board B is inserted along the insertion path constituted by the first slope 19, the second slopes 23 and third slopes 24, as illustrated in FIG. 12, and after the forward end of the subsidiary board B contacts with the abutment 20, the rear end of the subsidiary board B is depressed toward the base portion 13 of the housing 41 to pivot the subsidiary board B, completing the attachment of the subsidiary board B to the connecting component as illustrated in FIG. 13.

In Embodiment 2, the ends of the housing connection terminals 12 on the side opposite from another ends connected to the subsidiary board connection terminals 32 extend outwardly from the housing 41 and are connected with a wiring pattern of an electric circuit formed on the main board P.

Thus, also in Embodiment 2 where the housing 41 is secured to the main board P, the subsidiary board B can be smoothly attached to the connecting component through the use of the gull wing-shaped housing connection terminals 12 having tips that are not turned up, and the subsidiary board connection terminals 32 can be in contact with the housing connection terminals 12 without forming any stubs.

Embodiment 3

Figure 14:
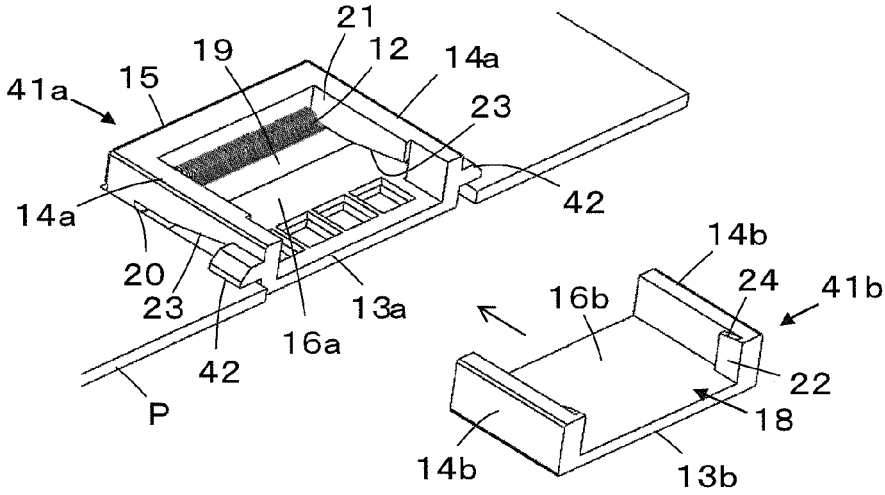
FIG. 14 is a perspective view of a connecting component according to Embodiment 3.

FIG. 14 illustrates a connecting component according to Embodiment 3. The connecting component is the same as one according to Embodiment 2 illustrated in FIG. 9 except for the housing 41 being divided into two members.

The connecting component comprises a housing 41*a* secured to the main board P, the housing connection terminals 12 connected to the housing 41*a*, and an auxiliary member 41*b* detachably attached to the housing 41*a*.

The housing 41*a* comprises a base portion 13*a*, a pair of side walls 14*a*, and the end wall 15. The first slope 19 is formed on a top surface 16*a* on the side of the base portion 13*a* closer to the end wall 15. The bosses 21 are formed on the pair of the side walls 14*a* near the end wall 15. The bosses 21 each have the second slopes 23 formed on the lower surfaces thereof. The wall surface of the end wall 15 forms the abutment 20. The side walls 14*a* each have the support member 42 on the outside thereof.

The auxiliary member 41*b* comprises a base portion 13*b* and a pair of side walls 14*b*. The side walls 14*b* have the bosses 22 at their end portions with the third slopes 24 formed on the upper surfaces of the bosses 22. The opening 18 is formed between the bosses 22.

The housing 41*a* and the auxiliary member 41*b* have a linking mechanism, not shown, for detachably connecting each other. With the housing 41*a* connected with the auxiliary member 41*b*, the side walls 14*a* of the housing 41*a* are connected with the side walls 14*b* of the auxiliary member 41*b* to form an extended side wall. The base portion 13*a* of the housing 41*a* is connected with the base portion 13*b* of the auxiliary member 41*b* to form an extended base portion, and the top surfaces 16*a* and 16*b* form a leveled continuous plane.

In a state that the housing 41*a* and the auxiliary member 41*b* are connected to each other, the subsidiary board B is inserted, as in the above Embodiments 1 and 2, and after the forward end of the subsidiary board B contacts with the abutment 20, the rear end of the subsidiary board B is depressed toward the base portion 13*b* of the auxiliary member 41*b* to pivot the subsidiary board B, completing the attachment of the subsidiary board B to the connecting component.

Figure 15:
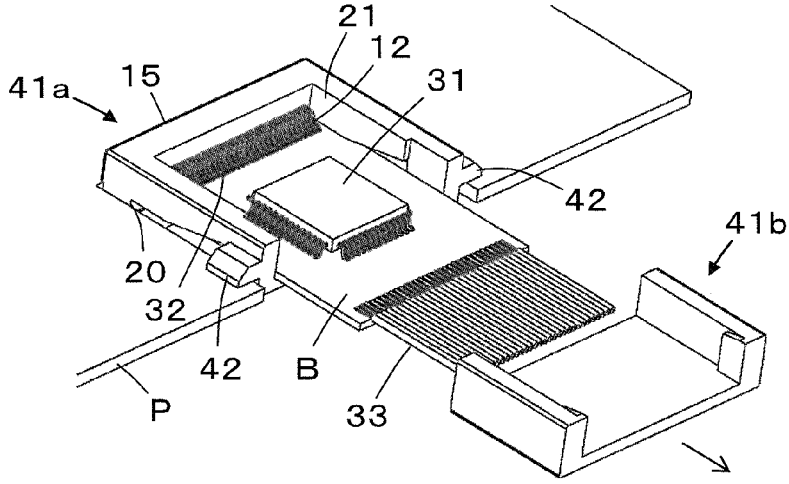
FIG. 15 is a perspective view of the connecting component according to Embodiment 3 with a subsidiary board mounted.
Figure 16:
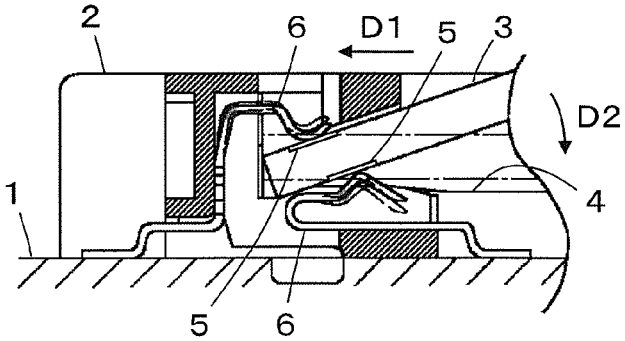
FIG. 16 is a partially cross sectional view of a conventional card connector.

When the connection of the subsidiary board B to the main board P is completed by connecting the housing connection terminals 12 and the respective subsidiary board connection terminals 32 by soldering, the auxiliary member 41*b* connected to the housing 41*a* through a linking mechanism, not shown, is detached and removed from the housing 41*a* as illustrated in FIG. 15. Because the subsidiary board B is now already connected with the main board P, removing the auxiliary member 41*b* causes no problem.

With such a structure in which the housing 41*a* and the auxiliary member 41*b* are detachably attached to each other, attachment of the subsidiary board B to each of a plurality of housings 41*a* can be achieved by using a single auxiliary member 41*b* repeatedly for a plurality of housings 41*a*.

Although not shown, lock members each made of an elastic piece similar to the lock members 25 in Embodiments 1 and 2 are preferably provided on the side walls 14*a* of the housing 41*a* to lock the position of the subsidiary board B supported on the top surface 16*a* of the base portion 13*a*.

As in Embodiment 2, the connecting component according to Embodiment 1 for attaching a subsidiary board to a connector part may also have a configuration such that the housing 11 is divided into a housing comprising the first slope 19, the second slopes 23 and the abutment 20 and an auxiliary member comprising the third slopes 24 and that the auxiliary member is detachably attached to the housing.

In the above Embodiments 1 to 3, the first guide portion, the second guide portions, and the third guide portions, embodied respectively by the first slope 19, the second slopes 23, and the third slopes 24, provide a guide in insertion through surface contact with the top surface or the rear surface of the subsidiary board B. The present invention is not limited thereto, however. The guide portions may have a configuration such, for example, that guiding is achieved by virtue of line contact or point contact with the top surface or the rear surface of the subsidiary board B, if a single insertion path enabling insertion of the subsidiary board B into the subsidiary substrate containing portion of the housing can be formed.

What is claimed is:

1. A connecting component for mounting a subsidiary board having subsidiary board connection terminals formed on its top surface near its forward end, the connecting component comprising:

a housing for accommodating the subsidiary board inserted in a direction along a top surface of the subsidiary board;

housing connection terminals secured to the housing and provided for connection to the subsidiary board connection terminals;

an abutment located beneath the housing connection terminals and with which a forward end of the subsidiary board inserted into the housing contacts;

a first guide portion located beneath the housing connection terminals for regulating a position of a bottom surface of the subsidiary board when the subsidiary board is inserted into the housing;

second guide portions located in front of the first guide portion as seen in a subsidiary board insertion direction for regulating a position of the top surface of the subsidiary board when the subsidiary board is inserted into the housing; and third guide portions located in front of the second guide portions as seen in the subsidiary board insertion direction on a straight line passing through the first guide portion and the second guide portions and disposed in a position away from the abutment by a distance longer than an overall length of the subsidiary board, the third guide portions regulating a position of the bottom surface of the subsidiary board when the subsidiary board is inserted into the housing, wherein the first guide portion, the second guide portions, and the third guide portions form an insertion path for inserting the subsidiary board into the housing without allowing the subsidiary board to contact with the housing connection terminals, and wherein by depressing a rear end of the subsidiary board toward a base portion of the housing after the subsidiary board is inserted into the housing along the insertion path until the forward end of the subsidiary board contacts with the abutment, the subsidiary board pivots to bring the subsidiary board connection terminals to contact with bottom surfaces of the housing connection terminals.

2. The connecting component according to claim 1, wherein the first guide portion, the second guide portions, and the third guide portions are constituted by slopes each having a same angle of inclination.

3. The connecting component according to claim 1, wherein the housing comprises a subsidiary board support portion for supporting the bottom surface of the subsidiary board as the subsidiary board pivots and the subsidiary board connection terminals contact with the bottom surfaces of the housing connection terminals.

4. The connecting component according to claim 3, further comprising lock members each made of an elastic piece for locking the subsidiary board in position supported by the subsidiary board support portion.

5. The connecting component according to claim 1, wherein each of the housing connection terminals has a gull-wing shape.

6. The connecting component according to claim 1, wherein the housing connection terminals are connected to the subsidiary board connection terminals by soldering.

7. The connecting component according to claim 1, wherein the first guide portion, the second guide portions, and the third guide portions are molded in one piece with the housing.

8. The connecting component according to claim 1, wherein the abutment, the first guide portion, and the second guide portions are formed in the housing, wherein the third guide portions are formed in an auxiliary member that is detachably attached to the housing, and wherein after the subsidiary board is inserted into the housing, with the auxiliary member attached to the housing, bring the subsidiary board connection terminals to connect to the housing connection terminals, the auxiliary member is removed from the housing.

9. The connecting component according to claim 1, wherein the housing is attached to one of a pair of connector parts connected to each other.

10. The connecting component according to claim 1, wherein the housing is secured to a main board to which the subsidiary board is mounted.

* * * * *